US005200903A

United States Patent [19]

Gilham

[11] Patent Number: 5,200,903

[45] Date of Patent: Apr. 6, 1993

[54] FRANKING MACHINE

[75] Inventor: Dennis T. Gilham, Ongar, United Kingdom

[73] Assignee: Alcatel Business Systems Ltd., Romford, United Kingdom

[21] Appl. No.: 932,380

[22] Filed: Aug. 19, 1992

Related U.S. Application Data

[63] Continuation of Ser. No. 818,352, Jan. 9, 1992, abandoned, which is a continuation of Ser. No. 733,175, Jul. 19, 1991, abandoned, which is a continuation of Ser. No. 216,013, Jul. 7, 1988, abandoned.

[30] Foreign Application Priority Data

Jul. 9, 1987 [GB] United Kingdom ..... 8716183

[51] Int. Cl.[5] ..... G06F 15/20

[52] U.S. Cl. ..... 364/464.02; 235/375; 235/432; 177/25.15

[58] Field of Search ..... 364/464.03, 464.02, 364/478, 466; 235/375, 432, 495; 177/25.15

[56] References Cited

U.S. PATENT DOCUMENTS

| | | | |
|---|---|---|---|
| 3,792,446 | 2/1974 | McFiggins et al. | 364/464.02 |
| 4,097,923 | 6/1978 | Eckert, Jr. et al. | 364/464.02 |
| 4,725,718 | 2/1988 | Sansone et al. | 235/495 |
| 4,752,950 | 6/1988 | Le Carpentier | 364/464.02 |
| 4,760,532 | 7/1988 | Sansone et al. | 364/464.02 |
| 4,812,992 | 3/1989 | Storace et al. | 364/464.02 |
| 5,122,962 | 6/1992 | Gilham | 364/464.02 |

*Primary Examiner*—Vincent N. Trans

*Attorney, Agent, or Firm*—Shoemaker and Mattare, Ltd.

[57] ABSTRACT

A franking machine is disclosed which comprises an electronic accounting and control device with registers for storing accounting data such as credit available and a printer connected to and controlled by the accounting and control device. The machine has an input/output connection for receipt of franking and addressing data from a computer to control the franking machine to print a franking impression and destination address on a mail item.

9 Claims, 3 Drawing Sheets

FRANKING MACHINE

RELATED APPLICATIONS

This is a continuation of U.S. patent application Ser. No. 07/818,352 filed Jan. 9, 1992 now abandoned which in turn is a continuation of U.S. patent application Ser. No. 07/733,175 filed Jul. 19, 1991 now abandoned which in turn is a continuation of U.S. patent application Ser. No. 07/216,013 originally filed Jul. 7, 1988 now abandoned.

BACKGROUND OF THE INVENTION

This invention relates to franking machines.

Known franking machines comprise a printing device for printing a franking impression on a mail item such as an envelope or label and an electronic unit for carrying out accounting and control unit functions. The electronic unit includes registers for storing a value of credit available for use in franking, a total value of franking used by the machine and a count of the number of mail items franked by the machine. The machine is also provided with a keyboard whereby a user may enter data into the franking machine and a display device to enable the franking machine to communicate data and operational information to the user. When it is desired to use the machine for franking a mail item, a user enters by means of a keyboard the value of franking desired and the electronic unit checks to ensure that there is sufficient credit available for the desired franking. If the available credit is sufficient the unit decrements the value of credit remaining in a descending register, increments an ascending register to indicate the new total of franking values used and increments the count of mail items franked and outputs a print control signal to permit printing to take place. The unit sets the printer to print the required value of franking and provided the print control signal has been output the printer is operated to print the required franking.

With currently available franking machines, the operations of addressing envelopes and inserting material into the envelopes are separated from the franking of the mail items. For example, addressing and filling envelopes is usually carried out by secretaries and typists whereas the franking operation is carried out in a mail room. Thus the envelopes are placed into typewriters or the like for the printing of a destination address and then after filling are carried to the mail room where the sealed envelopes are fed through a franking machine. As a result each mail item has to be handled a number of times.

SUMMARY OF THE INVENTION

According to the invention a franking machine comprises electronic means operable to carry out accounting and control functions; register means for storing a value of credit available for use in franking; input means connected to the electronic means for receiving data relating to franking and addressing of mail items; printing means; said electronic means being operative in response to received data relating to a desired franking to interrogate said register means to check if sufficient credit is available for said desired franking and being further operative if said check indicates sufficient credit to route said data relating to franking and addressing to said printer means to cause said printer means to print a franking and an address on a mail item.

Preferably the franking machine is used in combination with a computer having output means connected to said input means and programmed to be operable to send data to said franking machine relating to a value of franking required and an address to be printed on a mail item. In addition the franking machine may be operable to send data relating to operation of the franking machine to the computer.

BRIEF DESCRIPTION OF THE DRAWINGS

An embodiment of the invention will now be described with reference by way of example to the drawings in which.

DESCRIPTION OF THE PREFERRED EMBODIMENT

Figure 1:
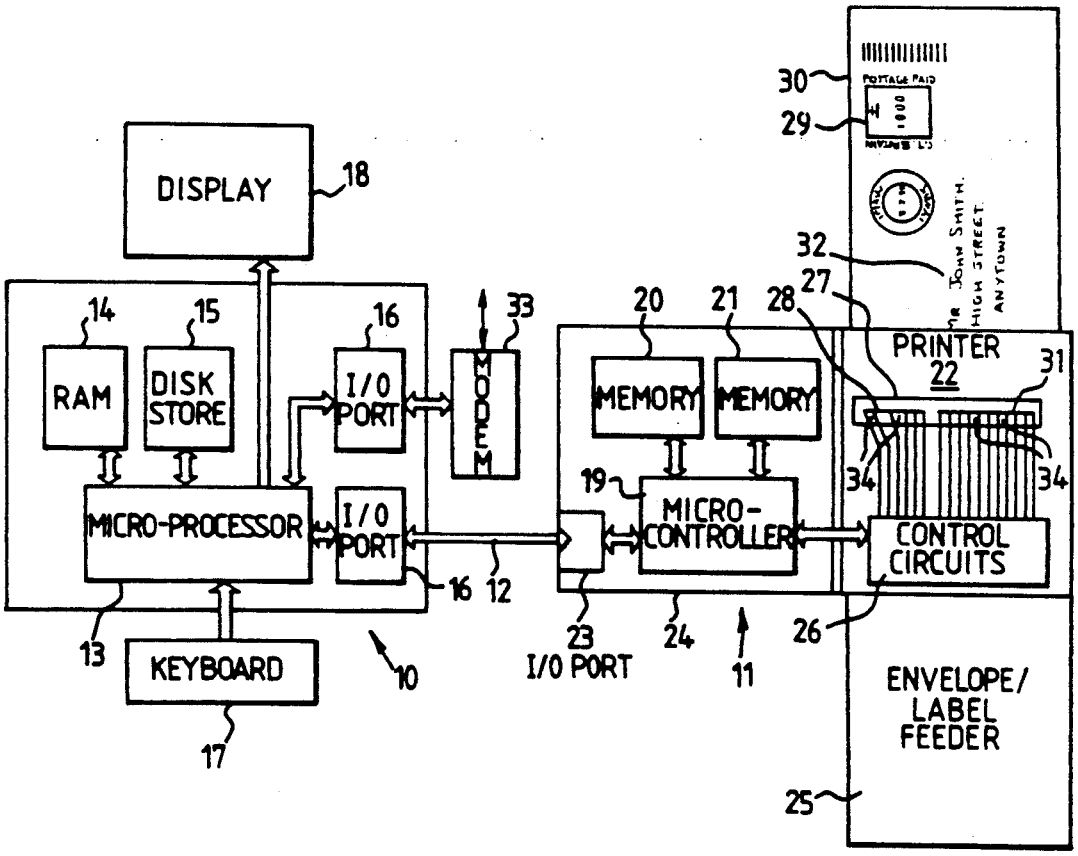
FIG. 1 shows a block schematic diagram of a personal computer or workstation connected to a franking and addressing device

Referring first to FIG. 1, a personal computer or workstation 10 has a peripheral device 11 connected to it by a multi-way cable 12. The personal computer 10 comprises a micro-processor 13 for carrying out data processing operations, a random access memory 14 and a floppy and/or hard disk store 15 for storing data. One or more input/output ports 16 are provided for sending and receiving data between the micro-processor 13 and other devices such as the peripheral device 11. The personal computer has a keyboard 17 for the input of data by a user and a display 18 for displaying data to the user. Such personal computers are well known and accordingly it is considered un-necessary for the understanding of the invention to describe the construction and operation of the computer in greater detail. Personal computers are commonly used under the control of a so-called word processing program for the typing of documents by means of the keyboard and for the subsequent amendment and correction of the typed data when required. During entry of the data comprising the document and amendment of the data, the data is stored in the random access memory 14. Subsequently the data may be written to the floppy or hard disk store 15 for retention. The data comprising the document may be output through one of the ports 16 to a printer to produce a hard copy of the document on paper.

As will be appreciated when the document typed into the computer consists of a letter there is usually a requirement to type a destination address on an envelope in which the letter is to be inserted. The peripheral device 11 is utilised not only for printing the destination address on the envelope but also to print a franking impression and/or code on the envelope. The device 11 comprises a micro-controller 19 for carrying out accounting and control functions, non-volatile memories 20, 21 containing registers for storing values of credit available for use in franking, the total value of franking used and a count of the number of mail items franked. The memories 20, 21 are identical to one another and store duplicate copies of the credit and usage data in order to ensure that the data is stored in a manner such that if the device should be subject to mal-function the data can be retrieved without corruption. The device 11 also includes a printer 22 operable to print an address and a franking impression on a mail item. An input/output port 23 connected to the micro-controller 19 provides an interface to the external cable 12 for the receipt and sending of data. In order to provide security and prevent fraudulent use of the franking machine 11, the micro-controller 19, memories 20, 21 and the input/output port 23 are housed in a secure casing 24 which can be sealed by the postal authority. The input/output port 23 is accessible from the exterior of the casing 24 to permit insertion of a connector plug on the end of the cable 12. The electronic circuits in the interior of the casing are protected from damaging voltages applied to the connections of the port 23 by means of protection circuits incorporated in the port. The protection circuits may include devices such as zener diodes to prevent excessive voltages appearing on the connections and fuses to prevent flow of excessive current.

Figure 2:
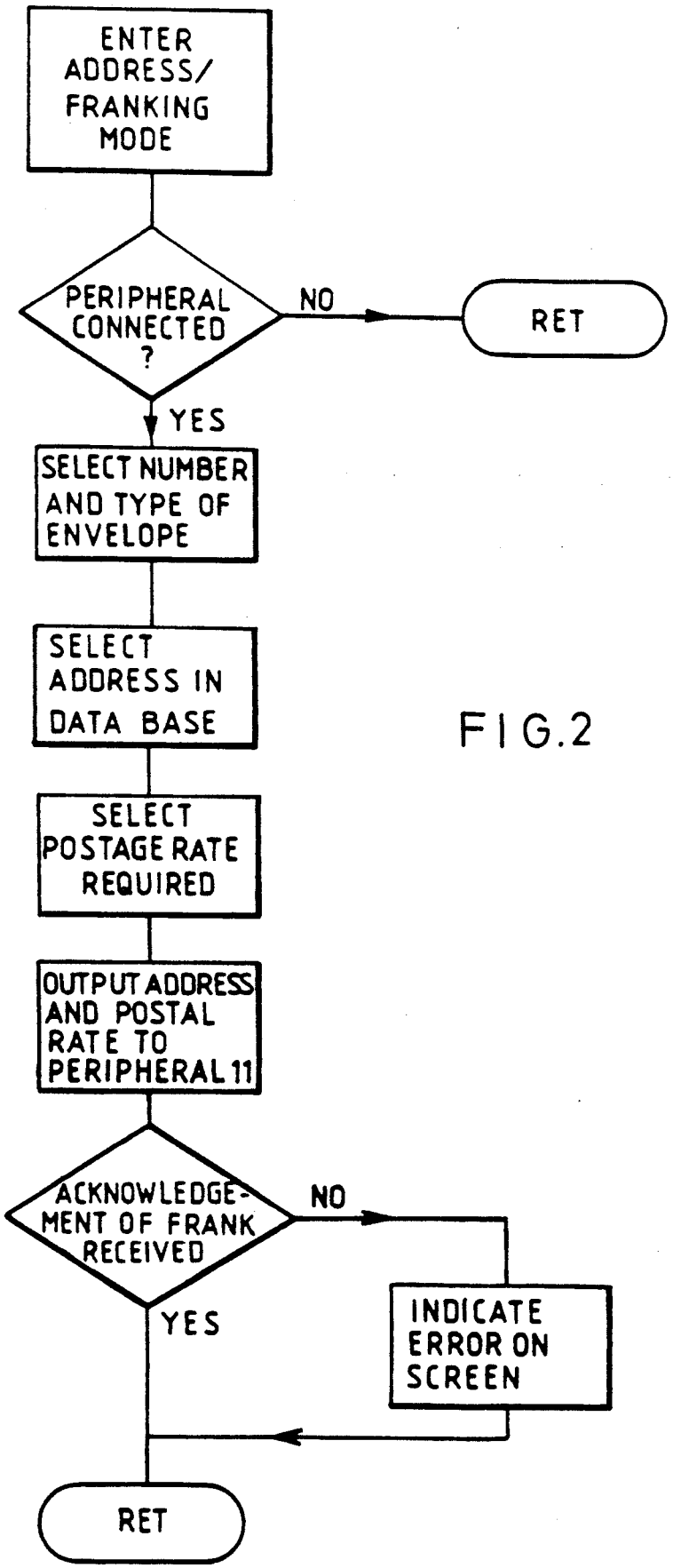
FIG. 2 is a flow chart showing a sequence of steps carried out by a program of a computer in addressing and franking of an envelope or label and FIG. 3 is a flow chart showing a sequence of steps carried out by a program of a franking machine in addressing and franking of an envelope or label.
Figure 3:
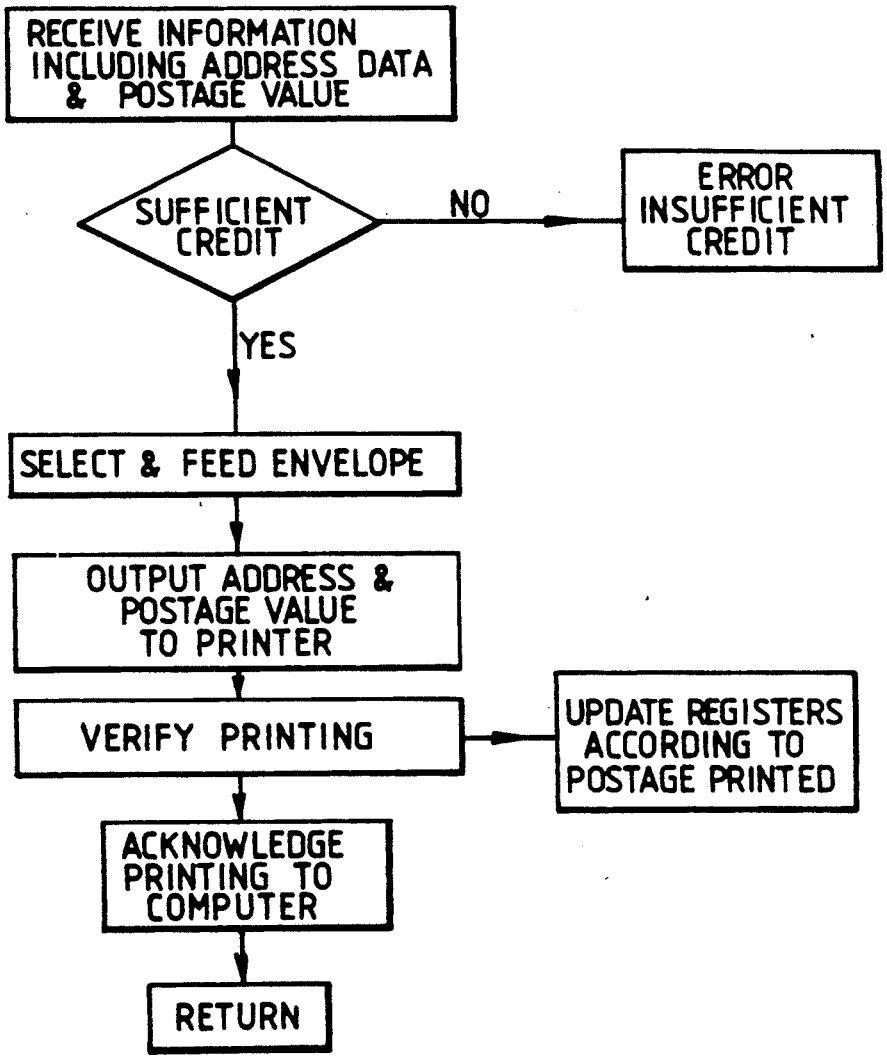

In order to utilise the personal computer 10 to control the operation of the printing and franking device 11, the computer is provided with a program in addition to the usual word processing program. This additional program is entered by the user keying an appropriate command on the keyboard. The sequence of major steps carried out by the additional program is shown in FIG. 2. Upon the user entering the address/franking mode, the program checks that the device 11 is connected to the input/output port 16 of the computer 10 and that the device 11 is operational. If connection of an operational device is not detected the program returns to its start and an error message is displayed. If connection of operational device 11 is detected the program displays a series of requests on the display to which requests the user is required to key in an acceptable response. It is preferred that the device 11 is provided with means 25 for selectively feeding different sizes of envelopes from hoppers to the printer 22. A device for feeding envelopes is described and claimed in our co-pending UK patent application No. 8716185 corresponding to co-pending U.S. patent application Ser. No. 07/216,012 filed Jul. 7, 1988, now U.S. Pat. No. 5,122,962, the disclosure of which is hereby incorporated in this specification. If such feeding means 25 is provided, the program requests the user to enter the size of envelope required. Next the program requests the destination address. Conveniently all destination addresses to be used are held in a data base of addresses in the disk store. Thus the user, in response to the request for the destination address, may enter a key word or number by which the required address may be retrieved from the data base. Lastly the user is requested to enter the postage value required. Upon receipt of this last response, the computer outputs, via the port 16, data representing the address and the postage value and an indication of the size of envelope selected by the user. Upon receipt of this data the micro-controller 19 including a program as shown in FIG. 3 carries out a check on the contents of the descending register to ascertain whether sufficient credit is available for the required franking. If sufficient credit is available, the micro-controller operates an envelope selector and feed mechanism to feed a selected size of envelope to the printer and routes the data to control circuits 26 of the printer to effect printing of the franking and of the destination address by printing means 27. The micro-controller 19 returns an acknowledgement of receipt of the franking data to the computer 10. If desired the computer may be programmed to display a message indicating that franking of an envelope is proceeding. In the event that insufficient credit is available an error signal is returned to the computer to cause the computer to display an "insufficient credit" message.

If desired, the last request for the user to specify the postage value may be modified. Instead the user may be requested to specify the number of sheets of paper intended to be inserted in the envelope and the postage rate applicable to the destination address. The computer stores a look-up table from which it is programmed to calculate the combined weight of the envelope selected and the intended contents and to calculate the postage value from the applicable postage rate. If desired the addresses held in the data base may have associated therewith a code indicating the postage rate applicable to the respective addresses. Hence the user would not need to enter the postage rate.

The printer preferably uses a dot matrix type of print head in which selective operation of print elements causes selected dots to be printed in a column on the envelope. By repeated selection and operation of the print elements in synchronism with feeding of the envelope past the print head a complete pattern may be printed. The printing means 27 may include two separate print heads, one head 28 being positioned to print the franking impression 29 and any other material along the upper portion of an envelope 30 and the other head 31 being positioned to print an address 32 in a central portion of the envelope. However if desired a single print head spanning both the franking and address portions of the envelope may be used. The printer control circuit 26 includes a character generator circuit operative in response to the data signal input from the computer 10 to produce print element drive signals such as to effect printing of the required characters and symbols on the envelope. A suitable form of dot printer is a thermal transfer printer in which ink carried on a thermal transfer ribbon fed in contact with the face of the envelope is transferred by printing elements 34 adjacent the rear of the ribbon which are heated selectively.

The computer may receive information via an internal or external modem 33 from a resetting centre to update the credit value in the franking machine registers. For reasons of security the computer would simply act as a courier of the information received from the resetting centre and may provide some non-secure application functions relating to the interface. Thus coded data received from the resetting centre would be passed to the franking machine in coded form without change and the coded data would be operated upon solely within the sealed secure housing of the franking machine.

I claim:

1. A franking machine system comprising:

computing means including data processing means;

data entry means connected to said data processing means into input address data and postage charge data relating to a mail item to said data processing means; and a first input/output port connected to said data processing means; a peripheral device comprising a franking machine including electronic circuit means to effect accounting and control operations;

a second input/output port connected to said electronic circuit; memory means connected to said electronic circuit means for registering a value of credit available for use in franking mail items and for registering a value of postage used in franking mail items;

printing means connected solely to and operable solely by print control signals output by said electronic circuit means to print on a mail item;

and a secure housing containing said electronic circuit means, said second input/output port and said memory means;

communication means interconnecting said first and second input/output ports;

said data processing means in response to input from said data entry means of destination data and postage charge data relating to a mail item sending corresponding destination data signals and postage charge signals via said first input/output port, said communication means and said second input/output port to said electronic circuit means of said peripheral device;

said electronic circuit means in response to said postage charge signals received from said data processing means checking a postage charge represented by said postage charge signals with the value of credit registered in said memory means to determine if said value of credit is sufficient relative to said postage charge and in response to said value of credit being sufficient outputting the print control signals directly to said printing means to effect at the same time printing on the mail item of a destination address corresponding to said address data and of a franking impression denoting payment of the postage charge corresponding to said postage charge data in respect of said mail item.

2. A franking machine system as claimed in claim 1 wherein the peripheral device includes mail item supply means operable selectively to feed an envelope to the printing means; the data entry means is operable to input envelope select data to the data processing means; the data processing means in response said envelope select data is operative to send an envelope select signal via the communication means to the electronic circuit means of said peripheral device; and said electronic circuit means is responsive to said envelope select signal to operate said mail item supply means to feed the envelope to the printing means to receive the destination address and the franking impression.

3. A franking machine system as claimed in claim 1 wherein the electronic circuit means of the peripheral device is operative in response to the value of credit registered in the memory means being sufficient for the postage charge and to printing by the printing means of the mail item to send an acknowledgement signal via said communication means to said data processing means; the data processing means includes display means and is operative in response to said acknowledgement signal to display a message indicating that printing of the franking impression on the mail item is proceeding.

4. A franking machine system as claimed in claim 1 wherein the electronic circuit means of the peripheral device is operative in response to the value of credit registered in the memory means being insufficient for the postage charge to send an error signal via said communication means to the data processing means; said data processing means includes display means and is operative in response to said error signal to display a message indicating insufficient credit.

5. A franking machine system as claimed in claim 1 wherein the computing means comprises a personal computer and the data entry means includes a keyboard for manual entry of destination address data and postage charge data relating to a mail item.

6. A franking machine system as claimed in claim 5 wherein the data entry means includes data storage means storing a database comprising destination address data relating to a plurality of destination addresses and means operable to select destination address data corresponding to a desired one of said destination address data corresponding to a desired one of said destination addresses for input to the data processing means.

7. A franking machine system as claimed in claim 1 wherein the printing means includes a first group of print elements operable by the print control signals to print the franking impression on the mail item denoting payment of the postage charge corresponding to said postage charge data in respect of said mail item and a second group of print elements operable by the print control signals to print the destination address on said mail item.

8. A franking machine system as claimed in claim 5 wherein the personal computer includes a programme of steps to effect a franking mode of operation including the steps of:

initiate franking mode of operation;

check that the peripheral device is operatively connected by the communication means to said personal computer;

receive input of destination data and postage charge data;

output destination data signals corresponding to said input destination data and output postage charge data signals corresponding to said input postage charge data via the communication means to the electronic circuit means of said peripheral device; and in response to receipt of an acknowledgement signal from said electronic circuit means return to said step of initiate franking mode of operation.

9. A franking machine system comprising:

computing means including data processing means;

data entry means connected to said data processing means to input address data and postage charge data relating to a mail item to said data processing means;

a first input/output port connected to said data processing means;

first printing means coupled to and controlled by said data processing means; and said data processing means being operable under control of first program means to control said first printing means;

a peripheral device comprising a franking machine including electronic circuit means to effect accounting and control operations;

a second input/output port connected to said electronic circuit; memory means connected to said electronic circuit means for registering a value of credit available for use in franking mail items and for registering a value of postage used in franking mail items;

second printing means connected solely to and operable solely by print control signals output by said electronic circuit means to print on a mail item;

and a secure housing containing said electronic circuit means, said second input/output port and said memory means;

communication means interconnecting said first and second input/output ports;

said data processing means being operative under second program means and in response to input from said data entry means of destination data and postage charge data relating to a mail item to send corresponding destination data signals and postage charge signals via said first input/output port to said electronic circuit means of said peripheral device;

said electronic circuit means being operative in response to said postage charge signals received from said data processing means to check a postage charge represented by said postage charge signals with the value of credit registered in said memory means to determine if said value of credit is sufficient relative to said postage charge and in response to said value of credit being sufficient to output the print control signals directly to said printing means to effect at the same time printing on the mail item of a destination address corresponding to said address data and of a franking impression denoting payment of the postage charge corresponding to said postage charge data in respect of said mail item.

* * * * *